United States Patent [19]

Boden

[11] 4,083,372

[45] Apr. 11, 1978

[54] CIGARETTE-SIMULATING INHALER

[76] Inventor: Robert Boden, 1580 Gaywood Dr., Altadena, Calif. 91001

[21] Appl. No.: 689,481

[22] Filed: May 24, 1976

[51] Int. Cl.[2] ..... A24D 1/00; A61M 15/06

[52] U.S. Cl. ..... 131/8 A; 131/170 A; 128/201

[58] Field of Search ..... 131/8 A, 170 R, 170 A, 131/261 A, 10.1; 128/201, 208

[56] References Cited

U.S. PATENT DOCUMENTS

| | | | |
|---|---|---|---|
| D. 170,716 | 10/1953 | Reseska | 131/15 RA |
| 2,854,985 | 10/1958 | Watkins | 131/268 X |
| 2,893,399 | 7/1959 | Jacoby | 131/10.1 |
| 3,339,558 | 9/1967 | Waterbury | 131/10.1 |
| 3,365,071 | 5/1971 | Cobb et al. | 131/170 A |
| 3,390,686 | 9/1968 | Lrby et al. | 131/10.11 |
| 3,404,692 | 10/1968 | Lompert | 131/170 A |

*Primary Examiner*—Robert W. Michell
*Assistant Examiner*—V. Millin
*Attorney, Agent, or Firm*—William P. Green

[57] ABSTRACT

A cigarette-simulating inhaler including a fluid-impermeable resiliently flexible outer tubular sheath open at both ends and containing a wick extending longitudinally within the sheath in one end thereof and a soft puncturable liquid-containing capsule in the other end thereof, the wick and capsule being separated from each other and forming an air chamber between them. The inhaler is activated by puncturing the end of the capsule nearer to the wick and then pinching the outer sheath at the location of the capsule in order to squirt the liquid into the air chamber prior to being absorbed by the wick. The empty capsule is then discarded.

13 Claims, 4 Drawing Figures

CIGARETTE-SIMULATING INHALER

BACKGROUND OF THE INVENTION

This invention relates to an improved inhaler in the size, shape and overall appearance of a cigarette to be utilized not only as a substitute for smoking, but also as an aid in stopping the smoking habit in the first place.

Ever since it has been universally recognized that the smoke of combustion of tobacco (or anything else, for that matter) produces carcinogens that cannot be satisfactorily filtered out without destroying the pleasure of smoking, there has been a need for a really safe and enjoyable "smokeless cigarette." Consequently, several cigarette-simulating inhalers have been proposed. They utilize a wick which is prefilled with an essential oil and past which a flow of air is drawn by the user so that some of the essential oil in vapor form is inhaled with the air in appealing primarily to the sense of smell of the user. Such devices have a contoured mouthpiece on one end and a simulated ash on the other. They essentially differ in the manner by which the wick is suspended within the central tubular element. These devices have a number of problems in common. Due to their relatively complicated structure, they must be manufactured by the more expensive injection molding procedure. Since there are a large number of parts involved, they cannot be assembled quickly at the factory. Also, because of the necessary time delay between time of manufacture and time of sale to the user, most of the essential oil will have evaporated from the wick and be lost to the packaging and atmosphere. And by necessity of their construction, these inhalers look stubby, awkward and fake.

A few novel cigarette filters have been proposed in which a so-called rupturable liquid-containing capsule is either embedded in the interior of a single long filter element or located between, and in contact with, two short filter elements. This concept represents a step forward, but there are still some problems. The user has no way of easily removing the ruptured capsule, which would seriously impair his ability to inhale through the filter. Similarly, there is no way of quickly and easily assembling such a device at the factory. The cost would be too high to manufacture a cigarette with such a filter. Furthermore, no practical or economical means have been proposed for effecting rupture of such a liquid-containing capsule. In the present state of the art, there is no soft capsule made, of which I am aware, that can be ruptured by simply squeezing it. If its shell were simply made thinner, then unwanted leaking around the seam would result. The use of a frangible capsule might obviate this problem, but there is no liquid-containing frangible capsule made, of which I am aware, in the present state of the art. If such a capsule could in fact be made, it would require custom machinery and would thus be much more expensive.

SUMMARY OF THE INVENTION

The present invention provides a novel type of cigarettesimulating inhaler, which overcomes the above discussed disadvantages. The device includes a resiliently flexible outer tubular sheath open at both ends and formed of fluid-impermeable material, such as polypropylene, in the shape and size of a cigarette. This sheath can be advantageously vacuum extruded at a fraction of the cost of being injection molded. Contained longitudinally within the sheath and desirably located midway between the ends is a wick. I have determined that an ordinary cigarette filter element makes the best wick for this purpose. The fibers are essentially polarized in the long axis direction for easy draw and will absorb up to several times their own weight in liquid without dripping or decomposing. Furthermore, such a filter element is already USFDA-approved for oral use. Located at one end of the wick is a hermetically sealed soft gel capsule containing an appropriate essential oil, said capsule desirably extending beyond the end of the sheath. The wick and capsule are separated from each other and form an air chamber between them. Since there are only three components, which are so inexpensive and easy to assemble at the factory, this inhaler has the advantage of being made as a convenient low-cost throwaway item. Yet the assembled inhaler will have a neat, slim and sleek appearance. To activate the device, the user punctures the end of the capsule nearer to the wick with a pin and then pinches the outer sheath at the location of the capsule in order to squirt the essential oil into the air chamber prior to being absorbed by the wick. He then discards the empty capsule and can draw on the inhaler off and on at his pleasure for up to a full day. When the desired aroma finally expires, he merely discards the device for a new one.

A particular feature of the invention relates to the outer sheath being extruded with an oval cross-section with a thin resiliently flexible side wall that permits easy insertion of the wick and capsule and from then on maintains gentle frictional contact with them as required.

Another feature of the invention relates to an air channel formed in the interior of the wick. This not only provides an ideal passageway through which the pin can be easily inserted to puncture the capsule, but also reduces the resistance of air flow through the inhaler.

A feature of the variational form of the invention relates to the air channel being formed between the inside surface of the sheath and a groove on the outside surface of the wick.

Still another feature of the invention relates to an exposed tit on the outer end of the capsule to facilitate removal of the empty capsule from the outer tubular sheath.

DESCRIPTION OF THE PREFERRED EMBODIMENTS

Figure 1:
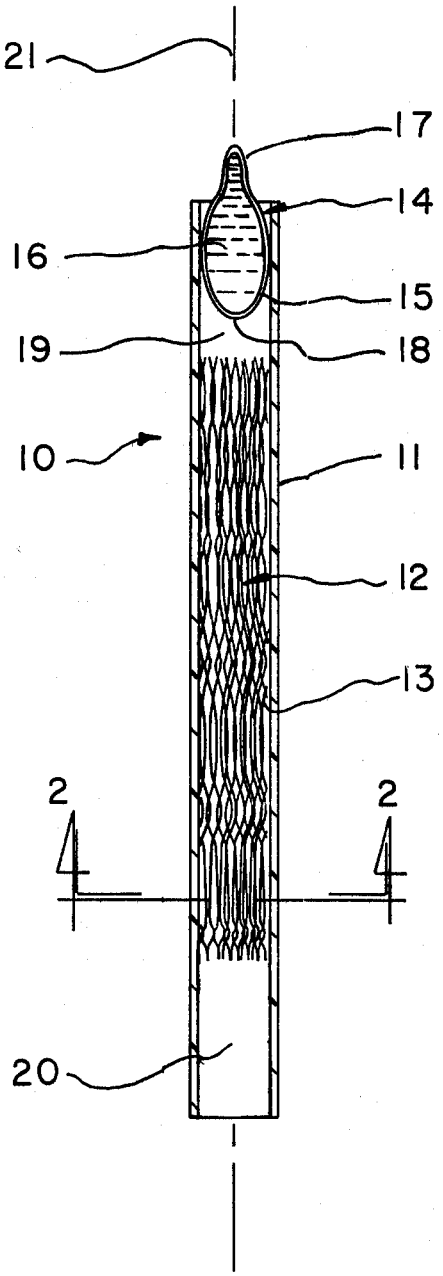
FIG. 1 is a central longitudinal section through a cigarette-simulating inhaler device formed in accordance with the invention prior to activation.

In the drawings, a cigarette-simulating inhaler device embodying the invention is designated generally at 10 and includes an outer tubular sheath 11 open at both ends and containing a wick 12 made up of fibers like 13 extending generally parallel to axis 21 and containing a capsule 14 made up of soft gelatin shell 15 within which is an appropriate essential oil 16. The wick is desirably about half as long as the sheath and located midway between the ends of the sheath and separated from the capsule, thus forming an air chamber 19 in one end of the sheath and a recession 20 at the other. The capsule desirably extends somewhat beyond its end of the sheath.

Figure 4:
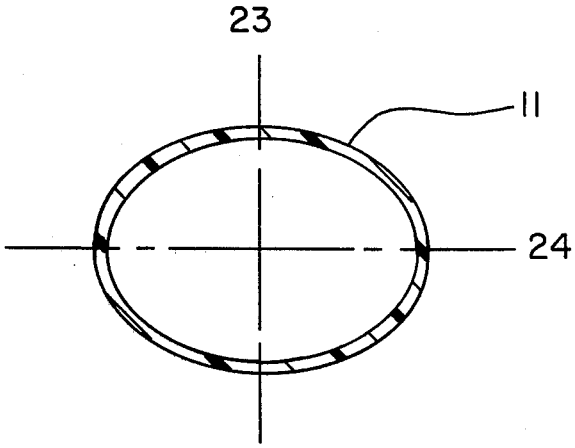
FIG. 4 is an enlarged cross-sectional view of the tubular sheath by itself as shown in the original unstressed oval configuration.

The sheath 11 is preferably made of polypropylene and is vacuum extruded with an oval cross-section having a minor axis 23 and a major axis 24 as shown in FIG. 4. The sheath is fluid-impermeable to prevent flow of liquid or air radially through its side wall. The wall thickness is very thin so as to be flexible and resilient. The inside oval cross-sectional area of the sheath is slightly greater than the circular cross-sectional area of the wick 12 or capsule 14. But the minor axis of the sheath is slightly less than the diameter of the wick or capsule. Hence, by the application of gentle pressure against the portions of the sheath wall opposite the major axis, the wick and capsule can be easily inserted. From then on, the portions of the sheath wall opposite the minor axis will exert a gentle inward force on the wick and capsule, thus maintaining their position by friction as required, even if the diameter of the wick is not exactly the same as that of the capsule. This gentle inward force is also important because the wick tends to contract radially inward in time due to the vacuum created within the sheath by the user when he draws on the inhaler. In order to most closely resemble a cigarette, the sheath should be nonglossy in finish and opaque white in color; although any color could be used. For example, brown could correspond to a coffee aroma, amber to a rum aroma, blue to a menthol aroma, etc. Since the method of manufacture of such sheathes is the same as that of ordinary plastic drinking straws and is well known in the state of the art, further details are unnecessary here.

Figure 2:
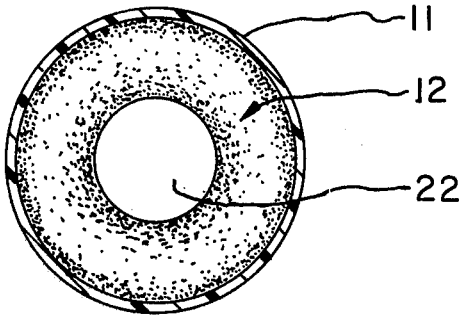
FIG. 2 is an enlarged cross-sectional view of the device taken on line 2 — 2 of FIG. 1.
Figure 3:
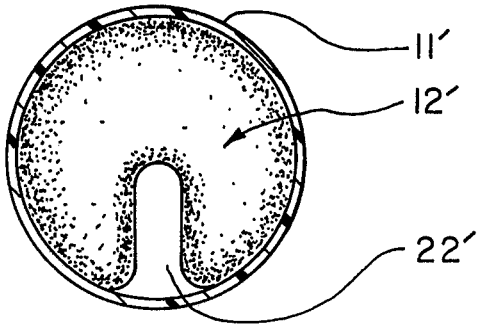
FIG. 3 is an enlarged cross-sectional view of a variational form of the invention taken on a line corresponding to line 2 — 2 of FIG. 1.

The wick 12 as shown in FIG. 1 is preferably identical to the filter element currently used on most brands of cigarettes. Such a filter element is most commonly made up of individual cellulose acetate and/or cotton fibers like 13. These fibers are oriented to have their lengths extending generally in the same direction and parallel to the long axis. Furthermore, each individual fiber runs substantially the length of the filter element. These coterminous generally parallel fibers thus form between the various fibers a large number of minute capillary passages through which a liquid can be drawn. Ideally, the fibers themselves should then absorb most of the liquid, thus re-opening the capillary passages for free air flow therethrough. In addition, these fibers are crimped at different locations along their lengths so that short portions of the fibers extend at different angles to the long axis. The fibers are bonded to each other at spaced locations where the kinked portions contact each other. This provides and maintains a sufficiently open capillary structure through which the user can draw air with less resistance. To further reduce the resistance of air flow, an air channel like 22 shown in FIG. 2 is formed in the interior of the wick, said air channel running the entire length of the wick and coincident to the long axis 21 thereof and having a diameter not to exceed the radius of the wick. This air channel also provides an ideal passageway through which the pin can be inserted to puncture the capsule 14 at point 18. Alternatively, an air channel like 22' shown in FIG. 3 could be formed between the inside surface of the sheath 11' and a groove on the outside surface of the wick 12', said groove running the entire length of the wick and parallel to the long axis thereof and down to a depth of the radius of the wick. It should be pointed out that neither air channel 22 nor 22' is necessary for the capsule to be punctured. Since the fibers of the wick are generally parallel to the long axis, loosely packed and flexible, the pin can still be inserted longitudinally through the interior of the wick to effect the puncture of the capsule. Because the method of manufacture of such type of cigarette filter elements is now well known in the state of the art, the details of their fabrication need not be discussed here.

The capsule at 14 consists of a hermetically sealed soft gelatin shell 15 within which is an appropriate essential oil 16 and protruding from the outer end of which is an optional tit 17 as shown in FIG. 1. The main body of the capsule is preferably oblong in shape. In the conventional pharmaceutical applications, the tit would be cut off with a pair of scizzors, and the contents of the capsule would be squeezed out. However, in this particular application, the capsule is desirably punctured on the opposite end at 18 with a pin, and the tit is used to facilitate pulling out the capsule from the outer tubular sheath 11 after the contents of the capsule have been evacuated. The capsule could be factory filled with an essential oil or any other desirably flavored vegetable oil, such as tobacco, fresh roasted coffee grounds, rum, brandy, etc. Similarly, the capsule shell could be of any desirable color, such as opaque white for the tobacco aroma, brown for the coffee aroma, amber of the rum aroma, etc. Basically, such capsules are made from two gelatin ribbons passing between two high speed die rolls, the material to be encapsulated being pumped through narrow orifices in a wedge riding on the gelatin. When the fill material leaves the wedge, portions of the gelatin ribbon are forced into pockets on each die roll. The filled capsule halves are then hermetically sealed together and cut from the ribbon. Since the method of manufacture of such capsules is identical to that used by pharmaceutical manufacturers to make their vitamin capsules and is also well known in the state of the art, further details of their fabrication are unnecessary here.

The cigarette-simulating inhaler 10, the components of which have been described in detail above, is very easy to use. It is contemplated that each carton of inhalers would include a small hat pin, which the user can run through the air channel 22 in order to puncture the capsule 14 at point 18. Holding the inhaler at approximately a 45° angle with the capsule on top, he then slowly but surely pinches the sheath 11 at the location of the capsule, which squirts the essential oil 16 into the air chamber 19 without passing clear through the open air channel 22. He should allow a few seconds for the wick 12 to completely absorb the essential oil. Pulling it out by the protruding tit 17, he can now throw away the empty capsule, and the inhaler is ready for use. For best results, he should draw on the former capsule end of the inhaler on and off at his pleasure for up to a full day. To maximize his sense of smell, he should exhale through his nose the same way he savors the aroma of a fine rum or brandy. It is also contemplated that perhaps every eight inhalers would be packed in their own polyethylene bag with zip closure. There would be perhaps six such eight-packs per carton. When the user is not using a particular inhaler, he should store it in the polyethylene bag from which it came. This will not only keep any residual moisture from reaching his clothes, but also retard evaporation of the essential oil. When the aroma finally has expired, he need only discard the inhaler for a new one.

While certain specific embodiments of the present invention have been disclosed as typical, the invention is of course not limited to these particular forms, but rather is applicable broadly to all such variations as fall within the scope of the appended claims.

I claim:

1. A cigarette-simulating inhaler comprising:

a tubular sheath extending about an axis and having two open opposite ends, one of which is to be placed in the mouth of the user, said sheath having a resiliently flexible tubular side wall which is impermeable to air and liquid between said opposite ends of the sheath;

one wick longitudinally contained within and carried by said sheath and located in one end thereof, in which said wick is composed of individual fibers substantially running the entire length of the wick and parallel to the long axis thereof, said fibers being crimped at spaced locations to have short portions extending angularly with respect to the long axis, said fibers also being bonded to each other where the kinked portions are in contact, the resulting structure thus providing and maintaining a large number of small capillary passages through which a liquid can be drawn and subsequently absorbed into the fibers themselves so that the capillary passages are re-opened for free air flow therethrough; and a soft puncturable liquid-containing capsule contained within and carried by said sheath and located in the other end thereof, the wick and capsule being separated from each other and thus forming an air chamber between them wherein the inhaler is activated by puncturing the end of the capsule nearer the wick and then pinching the outer sheath at the location of the capsule in order to squirt the liquid into the air chamber prior to being absorbed by the wick.

2. A cigarette-simulating inhaler as recited in Claim 1, in which an air channel is formed in the interior of said wick, said air channel running the entire length of the wick and coincident to the long axis thereof and having a diameter up to but not to exceed the radius of the wick.

3. A cigarette-simulating inhaler as recited in Claim 2, in which said tubular sheath is oval in cross-section so that the portions of the side wall opposite the minor axis always exert a gentle inward force on the wick and capsule within the sheath, and in which said capsule is formed with a tit on its outer end, said tit protruding beyond the end of the tubular sheath.

4. A cigarette-simulating inhaler as recited in Claim 1, in which an air channel is formed between the inside surface of said tubular sheath and a groove on the outside surface of said wick, said groove running the entire length of the wick and parallel to the long axis thereof and down to a depth not to exceed the radius of the wick.

5. A cigarette-simulating inhaler as recited in claim 4, in which said tubular sheath is oval in cross-section so that the portions of the side wall opposite the minor axis always exert a gentle inward force on the wick and capsule within the sheath, and in which said capsule is formed with a tit on its outer end, said tit protruding beyond the end of the tubular sheath.

6. A cigarette-simulating inhaler as recited in claim 1, in which the tubular sheath is oval in cross-section so that the portions of the side wall opposite the minor axis always exert a gentle inward force on the wick and capsule within the sheath.

7. A cigarette-simulating inhaler as recited in claim 1, in which said capsule partly extends beyond the end of the tubular sheath.

8. A cigarette-simulating inhaler as recited in claim 1, in which said capsule is formed with a tit on its outer end, said tit protruding beyond the end of the tubular sheath.

9. A cigarette-simulating inhaler as recited in claim 8, in which the shell of said capsule is of one of the following opaque colors: white, tan, brown, amber, blue or green.

10. A cigarette-simulating inhaler as recited in claim 1, in which said capsule consists of a soft gelatin shell containing either an essential oil or a neutral vegetable oil flavored with one of the following flavors: tobacco, coffee, rum or brandy.

11. A cigarette-simulating inhaler as recited in claim 1, in which said fibers of said wick are made of cellulose acetate.

12. A cigarette-simulating inhaler as recited in claim 1, in which said tubular sheath is made of polypropylene with a non-glossy finish in one of the following opaque colors: white, tan, brown, amber, blue or green.

13. A cigarette-simulating inhaler as recited in claim 1, in which said capsule is oblong with its long axis coincident to that of the outer tubular sheath.

* * * * *